US009470016B2

(12) United States Patent
Liao

(10) Patent No.: US 9,470,016 B2
(45) Date of Patent: Oct. 18, 2016

(54) LOCK AND KEY FOR THE SAME

(71) Applicant: BLOFTOWN CO., LTD., New Taipei (TW)

(72) Inventor: Hung-Lin Liao, New Taipei (TW)

(73) Assignee: BLOFTOWN CO., LTD., New Taipei (TW)

( * ) Notice: Subject to any disclaimer, the term of this patent is extended or adjusted under 35 U.S.C. 154(b) by 112 days.

(21) Appl. No.: 14/386,136

(22) PCT Filed: May 23, 2013

(86) PCT No.: PCT/CN2013/000603
§ 371 (c)(1),
(2) Date: Sep. 18, 2014

(87) PCT Pub. No.: WO2014/186915
PCT Pub. Date: Nov. 27, 2014

(65) Prior Publication Data

US 2015/0114056 A1 Apr. 30, 2015

(51) Int. Cl.
*E05B 19/02* (2006.01)
*E05B 19/18* (2006.01)
(Continued)

(52) U.S. Cl.
CPC ..... *E05B 27/0003* (2013.01); *E05B 9/042* (2013.01); *E05B 9/084* (2013.01); *E05B 19/0035* (2013.01); *E05B 19/18* (2013.01); *E05B 27/005* (2013.01); *E05B 19/0017* (2013.01); *E05B 19/04* (2013.01); *E05B 27/0014* (2013.01); *Y10T 70/7486* (2015.04); *Y10T 70/7565* (2015.04); *Y10T 70/7672* (2015.04); *Y10T 70/7684* (2015.04);
(Continued)

(58) Field of Classification Search
CPC .... E05B 27/0003; E05B 9/084; E05B 19/18; E05B 9/042; E05B 27/005; E05B 19/0035; E05B 19/0017; E05B 19/04; E05B 2009/043; E05B 9/045; E05B 27/001; E05B 27/0014; Y10T 70/7802; Y10T 70/7486; Y10T 70/7876; Y10T 70/7881; Y10T 70/7893; Y10T 70/7565; Y10T 70/8027; Y10T 70/7672; Y10T 70/7684
USPC ..... 70/358, 493, 494, 395, 408, 409, 401, 70/411, 432, 382–385, 372–375, DIG. 37, 70/DIG. 44, DIG. 59, DIG. 71
See application file for complete search history.

(56) References Cited

U.S. PATENT DOCUMENTS 939,679 A * 11/1909 Freud ..... E05B 19/18 70/411
1,022,900 A * 4/1912 Von Vargyas ..... E05B 19/18 70/408
(Continued)

*Primary Examiner* — Lloyd Gall
(74) *Attorney, Agent, or Firm* — Ming Chow; Sinorica, LLC

(57) ABSTRACT

The present invention relates to a lock and a key for the same, and multiple modular lock core units are mounted in the lock. Multiple lock bead units having specific standard are mounted in each lock core unit. Each lock bead unit is detachable and is able to rearrange the permutations of the lock bead units. The key includes a handle, a core bar and multiple unlocking blocks. The core bar is connected with the handle. The unlocking blocks are detachable, are mounted around the core bar and have multiple lock teeth sequentially formed around the inner peripheries of the unlocking blocks. A user can adjust the permutations of the key teeth of the key to unlock the lock that has different permutations of the lock bead units, also can change the permutations of the lock core units to get the same effects.

9 Claims, 13 Drawing Sheets

(51) Int. Cl.

| | |
|---|---|
| ***E05B 19/24*** | (2006.01) |
| ***E05B 27/06*** | (2006.01) |
| ***E05B 27/00*** | (2006.01) |
| ***E05B 9/04*** | (2006.01) |
| ***E05B 9/08*** | (2006.01) |
| *E05B 19/00* | (2006.01) |
| *E05B 19/04* | (2006.01) |

(52) U.S. Cl.

CPC ..... *Y10T 70/7802* (2015.04); *Y10T 70/7876* (2015.04); *Y10T 70/7881* (2015.04); *Y10T 70/7893* (2015.04); *Y10T 70/8027* (2015.04)

(56) References Cited

U.S. PATENT DOCUMENTS 1,107,376 A * 8/1914 Thiman ..... E05B 29/00 70/377
1,252,606 A * 1/1918 Neubauer ..... E05B 19/18 70/411
1,333,887 A * 3/1920 Warren ..... E05B 35/003 70/395
1,407,267 A * 2/1922 Hacklander ..... E05B 67/14 70/350
1,433,363 A * 10/1922 Freysinger ..... E05B 9/04 70/373
1,851,986 A * 4/1932 Rubsamen ..... E05B 27/083 70/378
1,892,419 A * 12/1932 Best ..... E05B 27/0007 70/375
1,964,787 A * 7/1934 Voight ..... E05B 9/084 70/369
2,038,677 A * 4/1936 Recht ..... E05B 19/18 70/358
2,155,440 A * 4/1939 Olson ..... E05B 29/00 70/358
2,356,891 A * 8/1944 Seiffert ..... E05B 19/18 70/395
2,430,914 A * 11/1947 Ciani ..... E05B 19/18 70/411
3,319,443 A * 5/1967 Perlick ..... E05B 17/04 70/373
3,427,413 A * 2/1969 Hawkins ..... E05B 45/06 200/43.08
3,500,670 A * 3/1970 Hawkins ..... E05B 45/06 70/375
3,595,043 A * 7/1971 Williams ..... E05B 27/0053 70/273
3,605,462 A * 9/1971 Hermann ..... E05B 27/00 70/375
3,656,328 A * 4/1972 Hughes ..... E05B 19/0023 70/276
3,810,416 A * 5/1974 Nelms, Jr. ..... B23Q 35/42 409/130
4,068,508 A * 1/1978 Genakis ..... E05B 9/086 70/373
4,068,509 A * 1/1978 Genakis ..... E05B 27/00 70/373
4,103,525 A * 8/1978 Kamiya ..... E05B 19/18 70/347
4,148,201 A * 4/1979 Miyamae ..... E05B 27/00 70/358
4,287,735 A * 9/1981 Brunken ..... E05B 19/18 70/395
4,292,824 A * 10/1981 Keller ..... E05B 9/042 70/373
4,432,218 A * 2/1984 Hoener ..... E05B 19/22 70/395
4,545,226 A * 10/1985 Urrestarazu-Borda . E05B 19/18 70/398
5,131,247 A * 7/1992 Hsu ..... E05B 19/18 70/358
5,148,690 A * 9/1992 Wang ..... E05B 27/00 70/358
5,176,015 A * 1/1993 Sussina ..... E05B 27/0053 70/340
5,177,466 A * 1/1993 Lai ..... E05B 27/00 200/61.66
6,058,750 A * 5/2000 Li ..... E05B 15/08 70/358
6,758,073 B2 * 7/2004 Yu ..... E05B 27/001 70/358
9,038,427 B2 * 5/2015 Shen ..... E05B 27/0075 70/358
9,359,792 B1 * 6/2016 Liao ..... E05B 27/005
2004/0103703 A1 * 6/2004 Bardachenko ..... E05B 35/001 70/411
2006/0096345 A1 * 5/2006 Chen ..... E05B 27/001 70/493
2015/0361689 A1 * 12/2015 Valente ..... E05B 19/00 70/409

* cited by examiner

LOCK AND KEY FOR THE SAME

BACKGROUND OF THE INVENTION

1. Field of the Invention

The present invention relates to a lock mechanism and more particularly to a lock and a key for the same, which allows a user to change permutations of interior components of the lock freely.

2. Description of Related Art

There are several types of locks in the conventional technical field, wherein a pin tumbler lock is the most common type. The structure of the pin tumbler lock comprises a lock shell and a lock core unit mounted in the lock shell and including a core shell, a lock core and multiple lock bead units.

The core shell is tubular and has a receiving space formed in the core shell and multiple outer bead holes formed through one side of the core shell.

The lock core is cylindrical and has a key hole formed through a central portion of the lock core, and multiple inner bead holes formed through one side of the lock core and communicating with the key hole. The lock core is rotatably mounted in the core shell. The outer bead holes of the core shell correspond in position respectively to the inner bead holes.

Each lock bead unit includes an outer lock bead, an inner lock bead and an elastic element. The lock bead units are respectively mounted in the outer bead holes and the corresponding inner bead holes. The outer lock beads and the elastic elements are located in the outer bead holes. The elastic elements abut the outer lock beads and make inner ends of the outer lock beads protrude in the inner bead holes. The inner lock beads are located in the inner bead holes. Outer ends of the inner lock beads and the inner ends of the outer lock beads abut each other. Inner ends of the inner lock beads protrude into the key hole. Wherein, lengths of the outer lock bead and the inner lock bead of each lock bead unit correspond to lengths of key teeth of a key.

When the key is inserted into the key hole of the lock core, the key teeth respectively push the inner lock beads and make the inner lock beads and the outer lock beads move to a common boundary located between an inner wall of the core shell and an outer periphery of the lock core. The key can rotate the lock core toward a direction relative to the core shell to lock or unlock the lock apparatus.

However, in the conventional lock core, a specific length ratio of each lock core can only fit a permutation of the key teeth in a specific key. If a user has multiple keys for multiple lock apparatuses, the appearances of the keys are too similar and hard to be distinguished.

If a copy of key is lost, the user has to remake a new key from a master key, or to change the lock apparatus. If the master key is lost as well, the user has no any other choice and has to change the apparatus to prevent a housebreaker. It is very inconvenient and takes lots of money and time. Therefore, the pin tumbler lock in conventional technology still needs to be improved.

SUMMARY OF THE INVENTION

To overcome the shortcomings of the conventional pin tumbler lock, the present invention provides a lock and a key for the same to mitigate or obviate the aforementioned problems.

In order to reach the said invention objective, the present invention provides a lock including a core shell, at least one lock core unit and a driving component; the core shell is a hollow sleeve; each one of at least one lock core unit includes a lock ring, a lock core and at least one lock bead unit; the lock ring is mounted around the lock core, the lock ring has multiple outer bead holes, the lock is rotatable relative to the lock ring and core has a key hole and multiple inner bead holes, each one of the at least one lock bead unit is mounted in one of the outer bead holes and one of the inner bead holes that align with to each other; the at least one lock core unit is mounted in the core shell; the driving component is rotatably mounted in the core shell, and one end of the driving component is connected with the lock core.

Wherein, each one of the at least one lock bead unit includes an elastic unit, an outer bead and an inner bead. A ratio of a length of the outer bead to a length of the inner bead of each lock bead unit is different from the ratio of the length of the outer bead to the length of the inner bead of any other lock bead unit.

Wherein, an amount of the lock bead units is four, respectively a first lock bead unit, a second lock bead unit, a third lock bead unit, and a fourth lock bead unit; the first lock bead unit, the second lock bead unit, the third lock bead unit, and the fourth lock bead unit are respectively and sequentially mounted in the outer bead holes and inner bead holes.

Wherein, the core shell has a display hole; multiple indication signs are formed on the lock ring and located out of the outer bead holes, part of the indication signs are exposed from the display hole.

Wherein, the lock ring has multiple ring engaging columns formed on a surface of the lock ring and multiple ring column recesses formed in another surface of the lock ring; the lock core has multiple core engaging columns formed in a surface of the lock core and multiple core engaging recesses formed in another surface of the lock core; the ring engaging columns of the lock ring and the core engaging columns of the lock core of each lock core unit engage respectively with the ring column recesses of the lock ring and the core engaging recesses of the lock core of the adjacent lock core unit.

Wherein, the driving component has multiple engaging columns formed on an end of the driving component and engaged with the core engaging recesses of the lock core, and has a fixing block mounted on another end of the driving component.

Wherein, an outer positioning ring is mounted around the driving component, has a hole for being disposed around on the outer periphery of the driving component and multiple engaging columns, the engaging columns of the outer positioning ring are respectively and correspondingly engaged in the ring column recesses of the lock ring, a spring is mounted between the core shell and the outer positioning ring; the core shell has positioning notches, and the outer positioning ring has buckle portions movably mounted in the positioning notches of the core shell.

Wherein, the outer positioning ring has a fixing notch formed in an inner periphery of the outer positioning ring, the driving component has a protrusion formed on an inner periphery of the driving component, and the fixing notch is aligned with the protrusion of the driving component.

Wherein, a rear seat is mounted at one end of the core shell, the rear seat has a seat through hole, an engaging disc is moveably mounted in the rear seat, a disc protrusion and a disc abutment block are formed on one side of the engaging disc, an eccentric hole is formed in the engaging disc and is located at an eccentric position, an elastic ring is mounted in the rear seat and respectively abuts on the disc abutment block of the engaging disc and an inner periphery of the rear seat, the disc protrusion constantly protrudes out of the seat through hole; and a switch rod is mounted on an outer periphery of the driving component, is located in the eccentric hole and moveably abuts on an inner periphery of the eccentric hole.

Wherein, a key positioning ring is rotatably mounted on one end of the core shell, the key positioning ring has a ring key hole and a column hole, the column hole communicates with the ring key hole in a radial direction, a positioning elastic unit and a positioning column are mounted in the column hole, the positioning column has a restricting flange, the positioning elastic unit abuts on the restricting flange to push the positioning column to moveably protrude out of the ring key hole of the key positioning ring.

Wherein, the lock further includes a lock housing being a hollow shell and having a receiving hole formed through a front surface of the lock housing, the core shell is detachably connected with the lock housing, a positioning protrusion protrudes from a periphery wall around the receiving hole, the disc protrusion is engaged with the positioning protrusion of the lock housing, a through hole is formed on a rear surface of the lock housing and communicates with the receiving hole, and the fixing block of the driving component is mounted through the through hole of the lock housing.

A key for the lock includes a handle, a core bar and multiple unlocking blocks; the handle is connected with the core bar which is a rod; each unlocking block has an inserting hole, and multiple lock teeth formed around an outer periphery of the unlocking block, a radial length of each one of the lock teeth is defined according to the ratio of the length of the outer bead 331 to the length of the inner bead 332 of a corresponding one of the at least one lock bead unit of the lock core units, and the unlocking blocks are detachably and sequentially mounted around the core bar.

Wherein, multiple indication signs are formed on outer peripheries of the lock teeth of each unlocking block.

Wherein, each unlocking block has a front fitting portion and a rear fitting portion formed on two ends of the unlocking block, the front fitting portion of each unlocking block is engaged with the rear fitting portions of each one of the adjacent unlocking blocks.

Wherein, an amount of the lock teeth of each unlocking block is four, respectively a first lock tooth, a second lock tooth, a third lock tooth and a fourth lock tooth.

Wherein, the handle has a placing hole, and a nut is mounted in the placing hole; the core bar has a connecting portion formed at one end of the core bar and having screw threads, and the connecting portion is inserted into the placing hole and is connected with the nut.

Wherein, the core bar has an outer toothed portion formed at another end of the core bar, and the shape of the outer toothed portion corresponds in shape and size to a key hole of the driving component.

Wherein, the outer toothed portion has multiple engaging recesses engaged with the front fitting portions of the unlocking block that is adjacent to the outer toothed portion.

A user can change the permutations of the lock bead units of the lock core units mounted in the lock, and the operation is easy. The user can rotate the key to remove the lock core from the lock housing. According to the indication signs of the lock bead units, the user can change the permutations of the lock bead units. The design concept of the present invention is similar to the design of the conventional combination lock. As long as the permutations of the lock bead units correspond to the permutations of the key teeth of the key, the lock can be locked or unlocked. The user also can adjust the permutations of the lock bead units of the lock core units to achieve enhanced security without changing the lock apparatus even if the key is lost. The user only needs to change the permutations of the lock core units, which can prevent the original key to be unlocked and save money and time from changing to a new lock apparatus.

DETAILED DESCRIPTION OF PREFERRED EMBODIMENT

Figure 1:
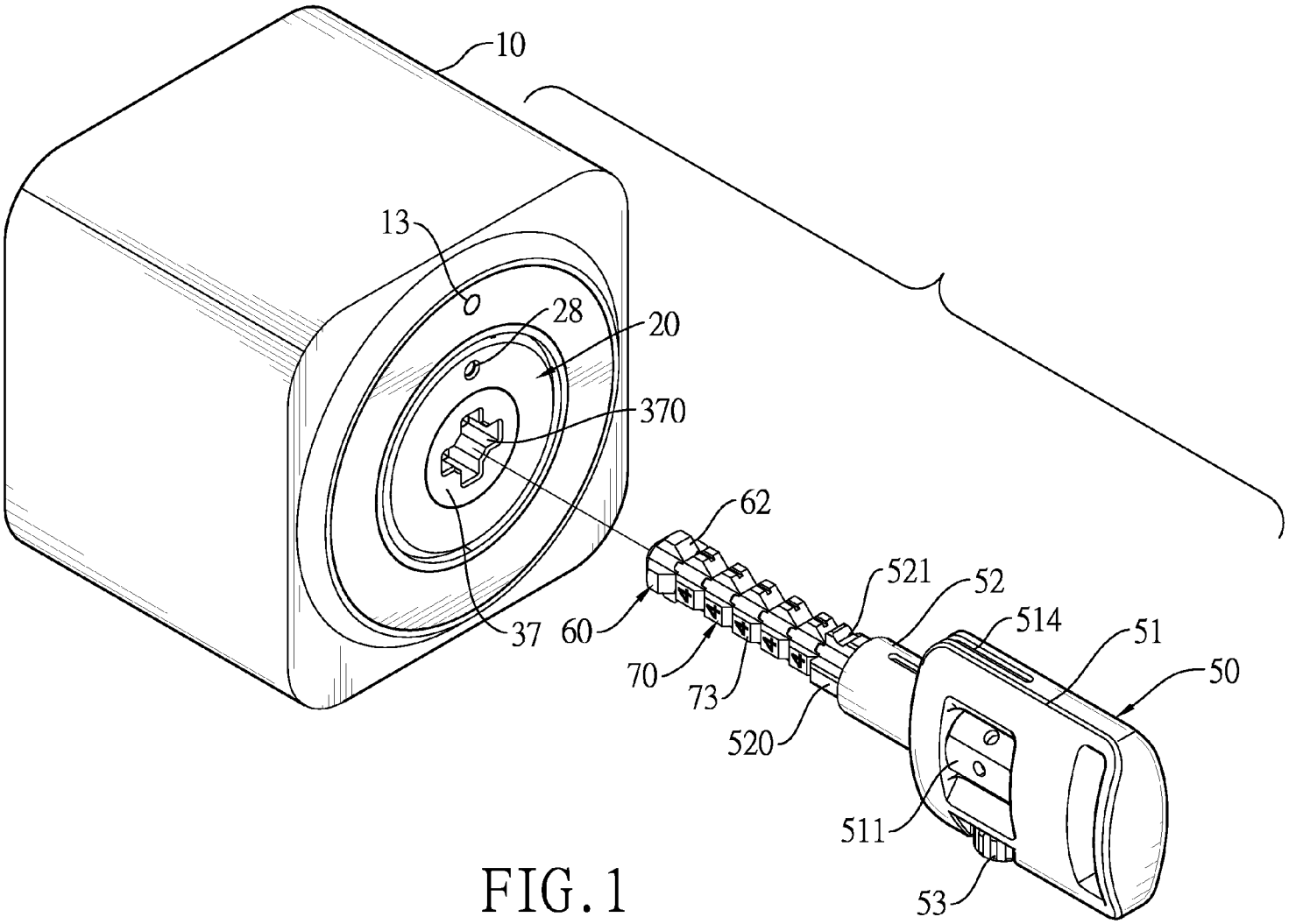
FIG. 1 is an exploded perspective view of a lock and a key in accordance with the present invention.

With reference to FIG. 1, the present invention relates to a lock and a key for the same, and the lock and the key are used in cooperation with each other.

Figure 2:
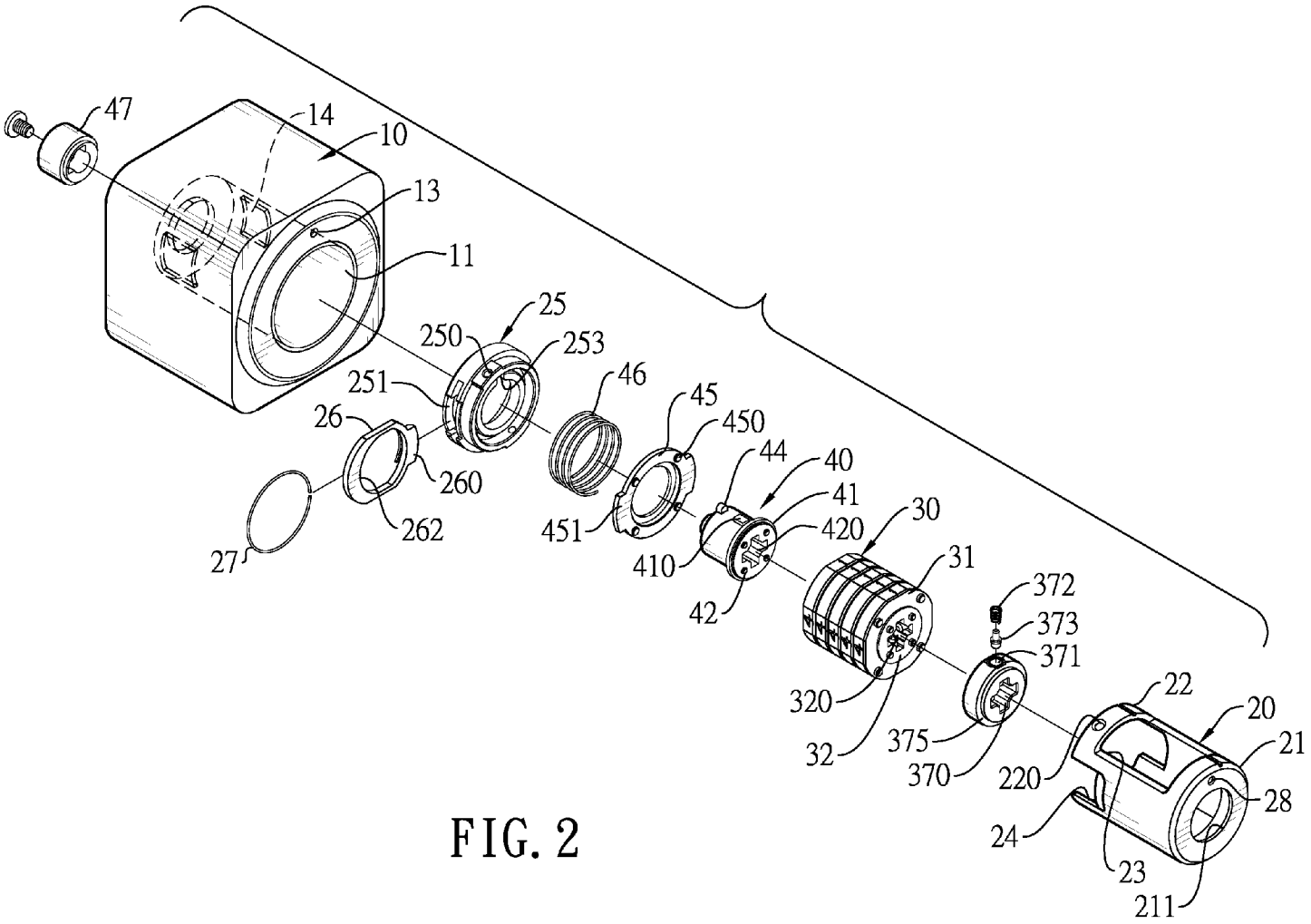
FIG. 2 is an exploded perspective view of the lock in FIG. 1.
Figure 3:
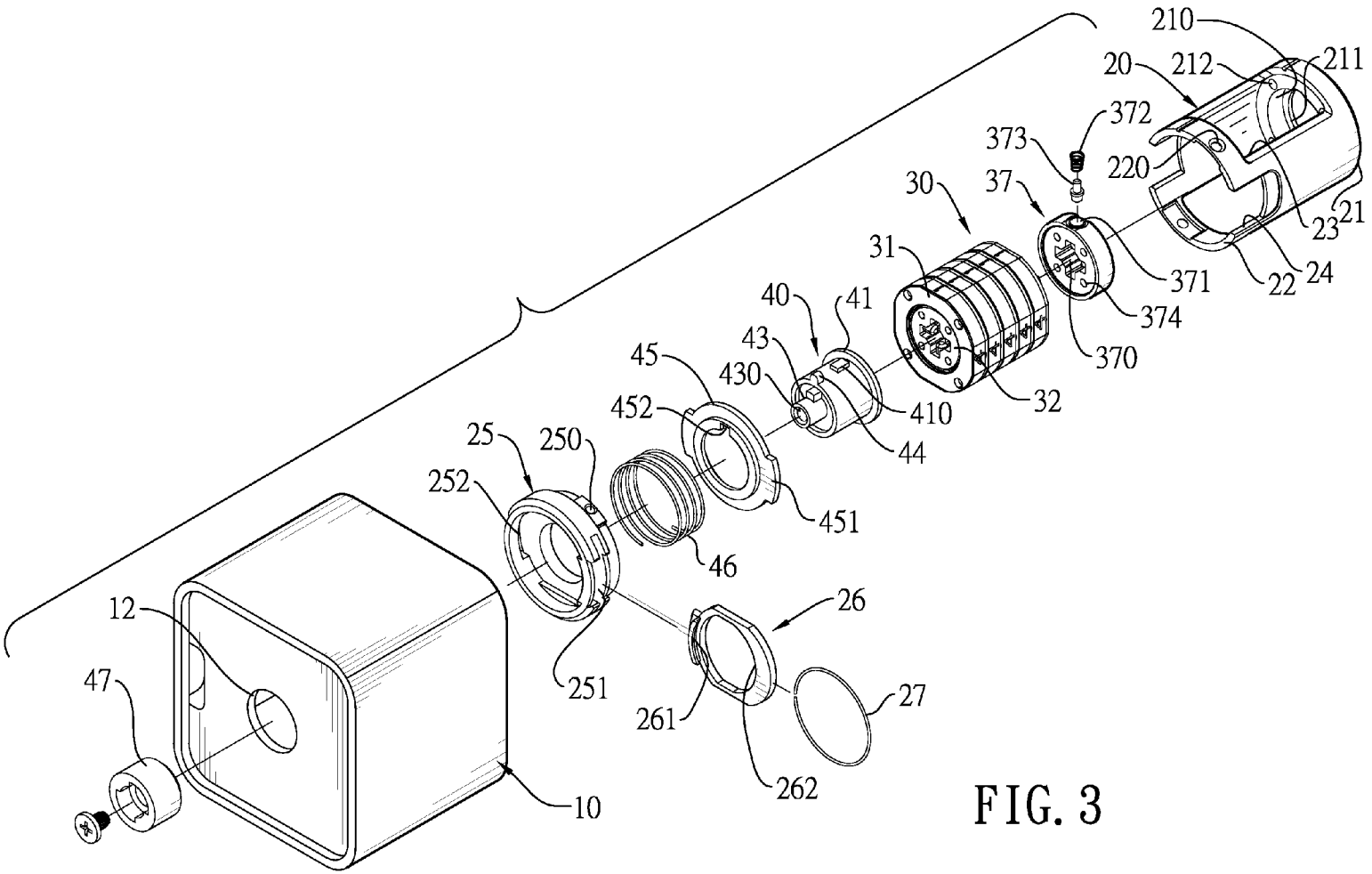
FIG. 3 is another exploded perspective view of the lock in FIG. 1.

With reference to FIGS. 2 and 3, the lock in accordance with the present invention includes a lock housing 10, a core shell 20, multiple lock core units 30 and a driving component 40.

The lock housing 10 is hollow and has a receiving hole 11, a through hole 12, a housing indication sign 13 and two positioning protrusions 14. The receiving hole 11 is cylindrical and is formed through a front surface of the lock housing 10. The through hole 12 is formed in a rear surface of the lock housing 10 and communicates with the receiving hole 11. The housing indication sign 13 is mounted on the front surface of the lock housing 10. The positioning protrusions 14 respectively protrude from a periphery wall around the receiving hole 11 and face each other.

According to situation of use, the lock housing 10 can be formed as a door which has the receiving hole 11, the through hole 12, the housing indication sign 13 and the positioning protrusions 14 formed on the positions as aforementioned.

With reference to FIGS. 2 to 5, the core shell 20 is detachably connected with the lock housing 10, is hollow, is cylindrical and has a front end 21, a rear end 22, two display holes 23, two positioning notches 24 and a core indication sign 28. The front end 21 and the rear end 22 are respectively located at two ends of the core shell 20. The front end 21 has a sleeve recess 210, a restriction hole 211 and multiple engaging holes 212. The sleeve recess 210 is formed in a rear surface of the front end 21. The restriction hole 211 is formed in a front surface of the front end 21 and communicates with the sleeve recess 210. The engaging holes 212 are formed in the rear surface and are arranged around the sleeve recess 210. The display holes 23 are respectively formed in an outer periphery of the core shell 20 and are aligned with each other. The positioning notches 24 are respectively formed in an outer edge of the rear end 22 and are aligned with the positioning protrusions 14 of the lock housing 10. The core indication sign 28 is formed on the front face of the front end 21.

The core shell 20 further includes a rear seat 25, an engaging disc 26 and an elastic ring 27. The rear seat 25 is annular and has a first fixing hole 250, a seat engaging hole 251, a seat through hole 252 and an engaging notch 253. The first fixing hole 250 is formed in an outer periphery of the rear seat 25. The rear end 22 has a second fixing hole 220 formed in an outer periphery of the rear end 22 and aligned with the first fixing hole 250. The rear seat 25 is mounted securely on the rear end 22 of the core shell 20 by a pin mounted through the first fixing hole 250 and the second fixing hole 220. The seat engaging hole 251 and the seat through hole 252 are respectively formed through two sides of the rear seat 25 and extend toward a radial direction into an inner periphery of the rear seat 25. The engaging notch 253 is formed in the inner periphery of the rear seat 25.

With reference to FIGS. 2 to 6, the engaging disc 26 is moveably mounted in the rear seat 25 via the seat engaging hole 251 and has a disc protrusion 260, a disc abutment block 261 and an eccentric hole 262. The disc protrusion 260 protrudes from an outer edge of the engaging disc 26 and is inserted into the seat through hole 252. The disc abutment block 261 protrudes from a rear surface of the engaging disc 26 and is located at the same side with the disc protrusion 260. The eccentric hole 262 is eccentrically formed in the engaging disc 26.

The elastic ring 27 is annular, is elastic and is mounted in the rear seat 25 via the seat engaging hole 251. One side of the elastic ring 27 abuts the disc abutment block 261, and the opposite side of the elastic ring 27 abuts the inner periphery of the rear seat 25. Therefore, the disc protrusion 260 constantly protrudes out of the seat through hole 252 to abut one of the positioning protrusions 14 and makes the rear seat 25 installed in the receiving hole 11.

Figure 4:
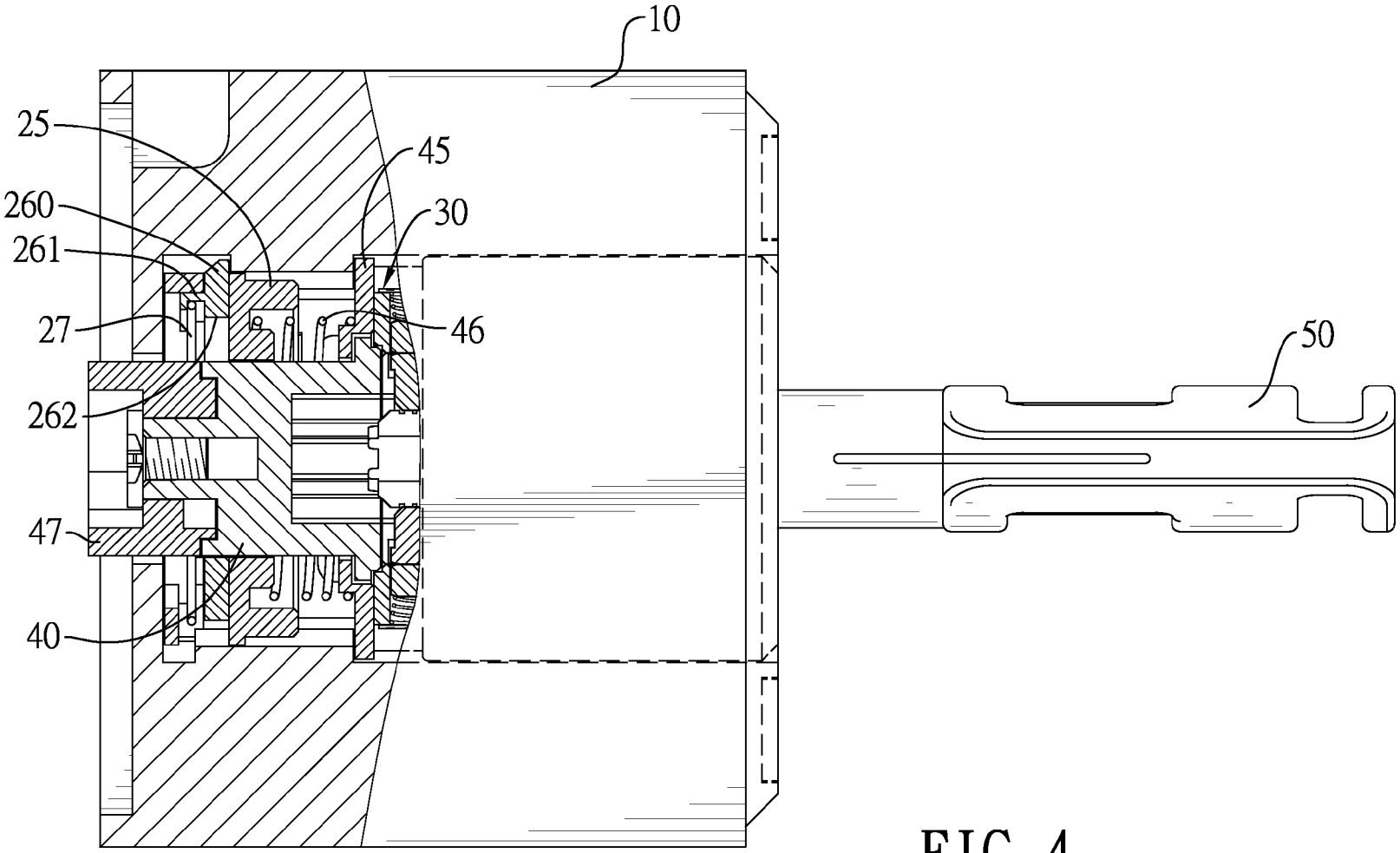
FIG. 4 is a top view in partial section of the lock and the key in FIG. 1.

With reference to FIGS. 2 to 4, an amount of the lock core units 30 is preferably five, the lock core units 30 are mounted in the core shell 20 and are arranged axially, and the adjacent lock core units 30 are engaged with one another. Each lock core unit 30 has a lock ring 31, a lock core 32 and multiple lock bead units.

The lock ring 31 is annular, and has a front surface, a rear surface, an inner periphery, an outer periphery, multiple outer bead holes 310, an indication shell 311, an annular recess 313, multiple ring engaging columns 314 and multiple ring column recesses 315. An amount of the outer bead holes 310 is preferably four and the outer bead holes 310 are formed through and disposed around the outer periphery of the lock ring 31 at even intervals of 90 degrees. The indication shell 311 is mounted around the outer periphery of the lock ring 31 and has multiple indication signs 312 which are sequential numbers such as number 1 to number 4 and are exposed from the display holes 23 of the core shell 20 for a user to observe the numbers of the indication signs 312 directly. The annular recess 313 is formed in the inner periphery of the lock ring 31 and is located adjacent to the rear surface of the lock ring 31. The ring engaging columns 314 and the ring column recesses 315 are respectively formed in the front surface of the lock ring 31 and the rear surface of the lock ring 31 and are aligned with each other.

The lock core 32 is disk-shaped, is mounted on the center of the lock ring 31, and has a front surface, a rear surface, an inner periphery, an outer periphery, a key hole 320, multiple inner bead holes 321, multiple core engaging columns 322, multiple core engaging recesses 323, and a core flange 324. The key hole 320 is radially formed at the center of the front surface of the lock core 32 and has multiple teeth recesses, preferably, the key hole 320 is cross-shaped and has four teeth recesses. The inner bead holes 321 are respectively formed in the outer periphery of the lock core 32, and are aligned and communicate with the outer bead holes 310. Each inner bead hole 321 has an abutment flange 325 formed on an inner surface of the inner bead hole 321. The amount of the inner bead holes 321 is same as that of the outer bead holes 310, which is four, and the inner bead holes 321 are disposed around the outer periphery of the lock core 32 at even intervals of 90 degrees. The core engaging columns 322 and the core engaging recess 323 are respectively formed in the front surface of the lock core 32 and the rear surface of the lock core 32 and are aligned with each other. The core flange 324 protrudes from an outer edge of the front surface of the lock core 32. The outer diameter of the core flange 324 is larger than the inner diameter of the lock ring 31 and is equal to the inner diameter of the annular recess 313.

The ring engaging columns 314 of the lock ring 31 are able to engage the ring column recesses 315 of the adjacent lock ring 31 and the engaging holes 212 of the core shell 20. The core engaging column 322 of each lock core 32 is able to engage the core engaging recess 323 of the adjacent lock core 32. The core flange 324 of the lock core 32 is mounted in the annular recess 313 of the lock ring 31.

An amount of the lock bead units is four, respectively a first lock bead unit 33, a second lock bead unit 34, a third lock bead unit 35, and a fourth lock bead unit 36. The lock bead units 33, 34, 35, 36 are respectively mounted in the outer bead holes 310 and the inner bead holes 321, and respectively and sequentially align to the indication signs 312 that respectively have number 1 to number 4. Each lock bead unit includes an elastic unit 330, an outer bead 331 and an inner bead 332. A ratio of a length of the outer bead 331 to a length of the inner bead 332 of each lock bead unit is different from the ratio of the length of the outer bead 331 to the length of the inner bead 332 of any other lock bead unit. Each inner bead 332 has an outer flange 333; the diameter of the outer flange 333 of the inner bead 332 is bigger than the inner diameter of the abutment flange 325. The inner beads 332 are respectively mounted in the outer bead holes 310, and the outer flange 333 of the inner bead 332 abuts on the abutment flange 325, so that one end of each inner bead 332 can protrude out of the key hole 320. The outer beads 331 are respectively mounted in the inner bead holes 321 and abut on top ends of the inner beads 332. The elastic units 330 are springs and respectively abut between the outer beads 331 and the indication shell 311. Therefore, when the inner beads 332 are pushed, the outer beads 331 and the elastic units 330 are moved elastically, such that the inner beads 332 can longitudinally move inside the outer bead holes 310.

Figure 5:
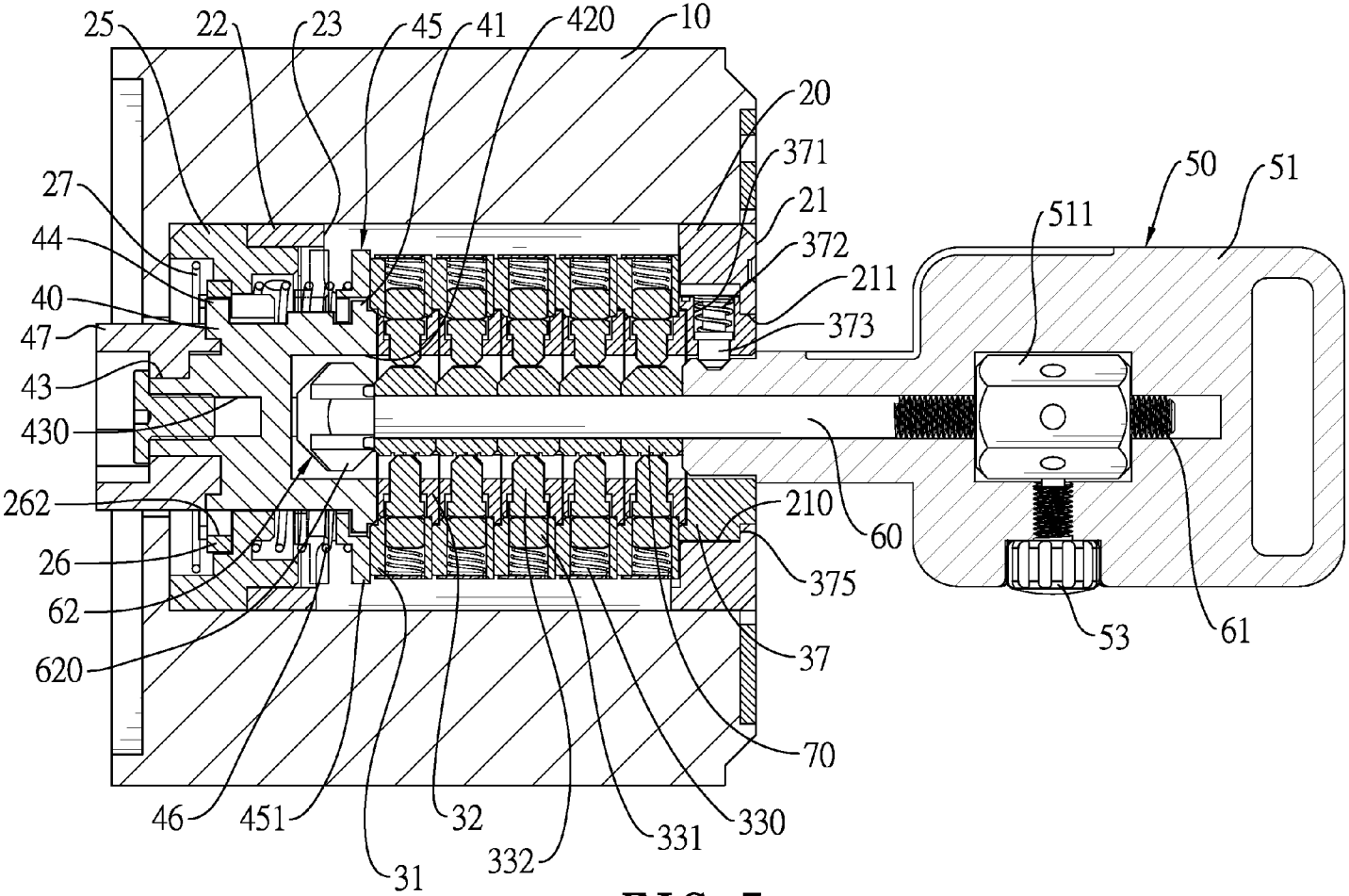
FIG. 5 is a side view in partial section of the lock and the key in FIG. 4.

With reference to FIGS. 2, 3 and 5, a key positioning ring 37 is mounted on a front end of the lock core unit 30 and mounted in the core shell 20. The key positioning ring 37 is disk-shaped, has an outer periphery, a front surface, a rear surface, a ring key hole 370, a column hole 371, a positioning elastic unit 372, a positioning column 373, multiple receiving recesses 374 and a step portion 375. The outer periphery of the key positioning ring 37 abuts an inner periphery of the sleeve recess 210.

The ring key hole 370 is formed through a center of the front surface of the key positioning ring 37 in a radial direction and has multiple teeth recesses. The column hole 371 is formed through the outer periphery of the key positioning ring 37. The positioning elastic unit 372 and the positioning column 373 are mounted in the column hole 371. The positioning elastic unit 372 is a spring, and one end of the positioning elastic unit 372 abuts on a top end of the positioning column 373, and the other end of the positioning elastic unit 372 abuts on the inner periphery of the sleeve recess 210. The positioning column 373 has a restricting flange which can keep the positioning column 373 stay within the column hole 371, and one end of the positioning column 373 can movably protrude into the ring key hole 370 by push of the positioning elastic unit 32. The positioning column 373 is aligned with the core indication sign 28. The receiving recesses 374 are formed in the rear surface of the key positioning ring 37, and are aligned and engaged with the core engaging column 322. The step portion 375 is formed on the front surface of the key positioning ring 37 and corresponds in shape and size to and engages in the restriction hole 211.

With reference to FIGS. 2, 3, 5, the driving component 40 is cylindrical and has a front surface, a rear surface, an outer periphery, a front flange 41, a protrusion 410, multiple engaging columns 42, a key hole 420, a connecting portion 43 and a switch rod 44. The front flange 41 is formed around the outer periphery of the driving component 40 and is adjacent to the front surface of the driving component 40. The protrusion 410 is formed on the outer periphery of the driving component 40. The engaging columns 42 and the key hole 420 are formed on the front surface of the driving component 40. The connecting portion 43 is formed on the rear surface of the driving component 40 and has a connecting hole 430. The switch rod 44 is mounted on the outer periphery of the driving component 40.

An outer positioning ring 45 and a spring 46 are mounted around the driving component 40. The outer positioning ring 45 is annular and has multiple engaging columns 450, two buckle portions 451 and a fixing notch 452. The engaging columns 450 are respectively engaged in the ring column recesses 315 of the lock ring 31. The buckle portions 451 respectively protrude from two sides of the outer positioning ring 45 and are engaged with the positioning notches 24. The fixing notch 452 is formed in an inner periphery of the outer positioning ring 45 and is aligned with the protrusion 410.

The driving component 40 is mounted in the core shell 20 and is located at the rear end 22 of the core shell 20. The engaging columns 42 of the driving component 40 are engaged with the core engaging recess 323 of the lock core 32. A gap is formed between the driving component 40 and a rear side of the lock ring 31 of the adjacent lock core units 30. One end of the spring 46 abuts the outer positioning ring 45, and the other end of the spring 46 abuts the rear seat 25. Due to the elastic force of the spring 46, the driving component 40 and the outer positioning ring 45 are constantly moved toward the lock core units 30 to connect the lock core units 30 with the driving component 40 together.

The switch rod 44 is located inside the rear seat 25 and protrudes toward an inner wall of the eccentric hole 262 of the engaging disc 26. When the driving component 40 is rotated, the switch rod 44 rotates and pushes the engaging disc 26 to retract the disc protrusion 260 of the engaging disc 26 into the rear seat 25. Thus, the core shell 20 can be removed from the receiving hole 11 of the lock housing 10.

The driving component 40 is further combined with a fixing block 47 that is securely mounted in the connecting hole 430 of the connecting portion 43 and protrudes out of the through hole 12 of the lock housing 10 for connecting a latch or other locking components.

Figure 9:
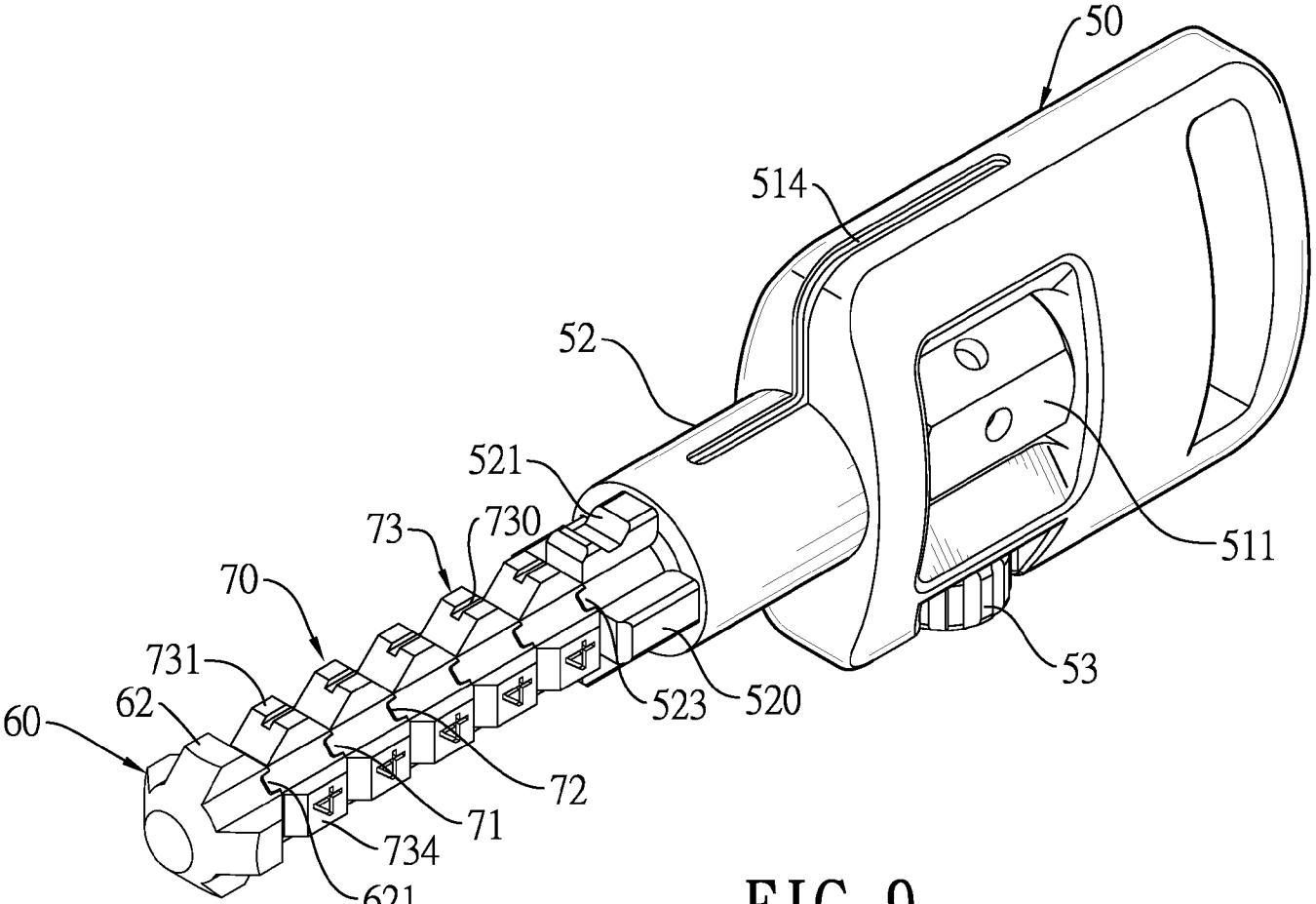
FIG. 9 is an enlarged perspective view of the key in FIG. 1.
Figure 10:
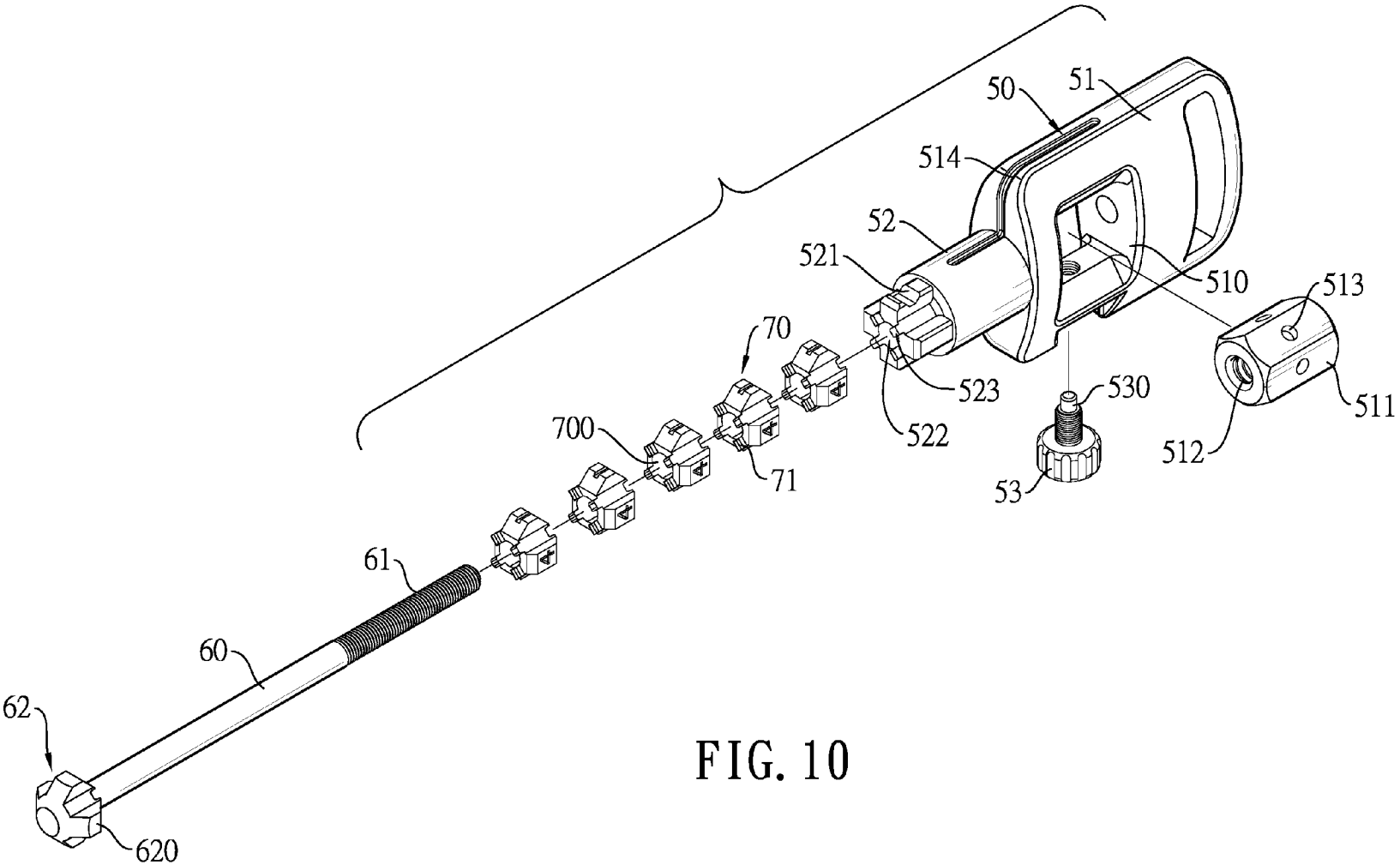
FIG. 10 is an exploded perspective view of the key in FIG. 9.
Figure 11:
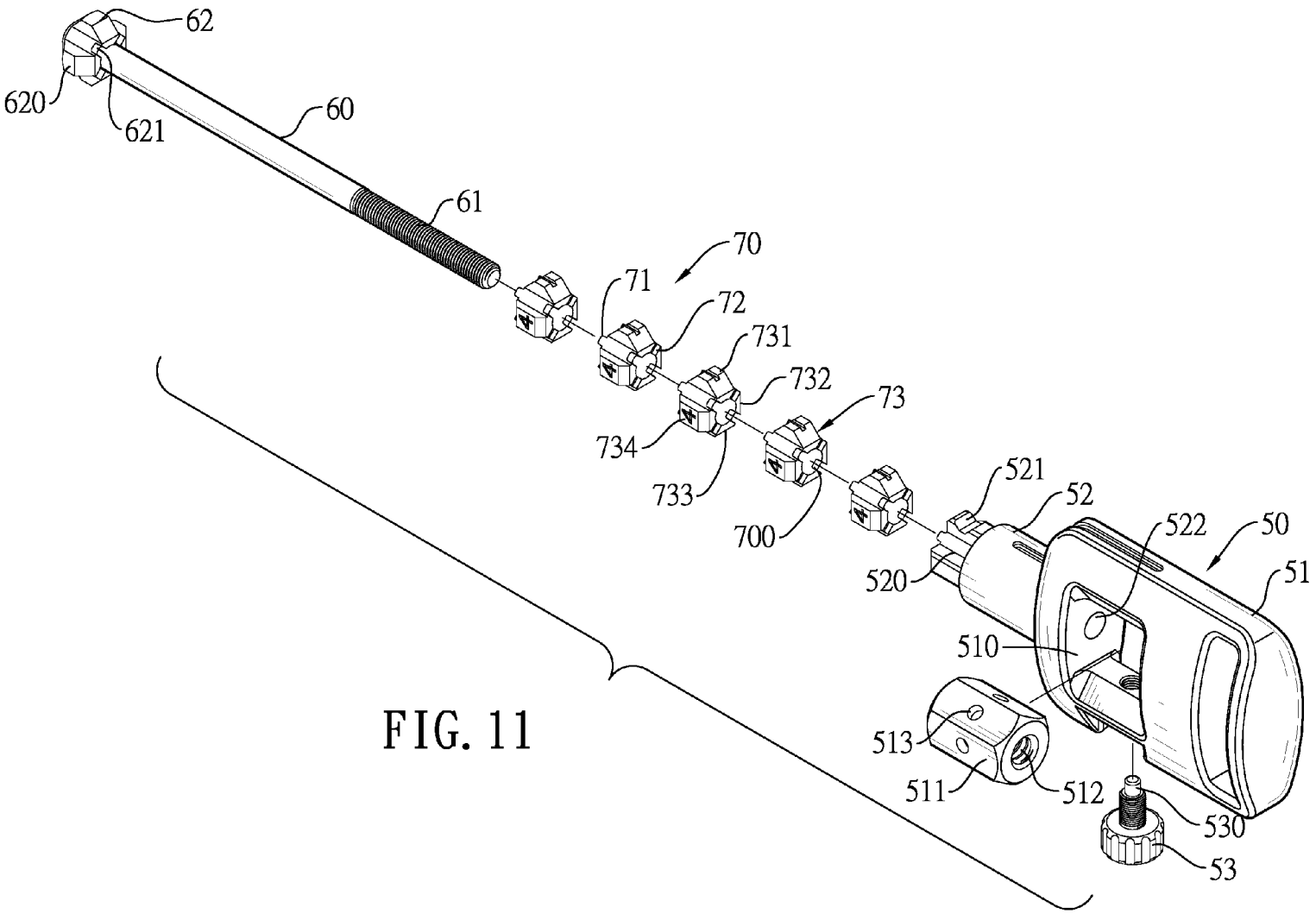
FIG. 11 is another exploded perspective view of the key in FIG. 9.

With reference to FIGS. 9 to 11, the key of the present invention includes a handle 50, a core bar 60 and multiple unlocking blocks 70.

The handle 50 includes a holding portion 51, a rod portion 52 and a positioning screw 53. The holding portion 51 has two flat surfaces, two side surfaces, a rear end, a placing hole 510 and a nut 511. The flat surfaces are respectively located at a top side and a bottom side of the handle 50. The side surfaces are respectively located at two sides of the handle 50. The placing hole 510 is formed through the side surfaces of the holding portion 51. The nut 511 is mounted in the placing hole 510 and has an inner threaded hole 512 and multiple positioning through holes 513. The inner threaded hole 512 is axially formed through the nut 511. The positioning through holes 513 are formed in and arranged around an outer periphery of the nut 511. The positioning screw 53 is mounted through one of the flat surfaces and has a threaded column 530 screwed in a corresponding one of the positioning through holes 513. A positioning sign 514 is mounted on the flat surface that is opposite to the positioning screw 53.

The rod portion 52 protrudes from the rear end of the holding portion 51 and has a rear surface, a toothed portion 520, a positioning recess 521, a central through hole 522 and multiple engaging protrusions 523. The toothed portion 520 is formed at one end of the rod portion 52 and has multiple lock teeth arranged longitudinally. The positioning recess 521 is formed in one of the lock teeth and is aligned with the positioning sign 514 of the holding portion 51. The central through hole 522 is axially formed through the rod portion 52, communicates with the placing hole 510, and is aligned with the inner thread hole 512 of the nut 511. The engaging protrusions 523 protrude from the rear surface of the rod portion 52 and are disposed around the central through hole 522.

The core bar 60 is elongated and has two ends, a connecting portion 61 and an outer toothed portion 62. The connecting portion 61 is formed at one end of the core bar 60 and has screw threads. The outer toothed portion 62 is formed at the opposite end to the connecting portion 61 and has multiple lock teeth 620 and multiple engaging recesses 621. The engaging recesses 621 of the outer toothed portion 62 are formed on a front face of the outer toothed portion 62.

Each unlocking block 70 has a front fitting portion, a rear fitting portion, an outer periphery, an inserting hole 700 and multiple lock teeth 73.

The inserting hole 700 is formed at a center of the unlocking block 70. The front fitting portion and the rear fitting portion match and correspond in shape and size to each other, and are respectively located at opposite ends of the unlocking block 70. The front fitting portion has multiple fitting protrusions 71. The rear fitting portion has multiple fitting recesses 72 respectively corresponding in shape and size to the fitting protrusions 71. The lock teeth 73 are formed around the outer periphery of the unlocking block 70 and have multiple indication signs 730 respectively corresponding to the indication signs 312 of the lock rings 31. A radial length of each one of the lock teeth 73 is defined according to the ratio of the length of the outer bead 331 to the length of the inner bead 332 of a corresponding one of the lock bead units of the lock core unit 30. Specifically, a sum of the radial length of each one of the lock teeth 73 and the inner bead of the corresponding one of the lock bead units is equal to the sum of the radial length of the other one of the lock teeth 73 and the inner bead of the corresponding one of the lock bead units.

Preferably, an amount of the lock teeth 73 is four, respectively a first lock tooth 731, a second lock tooth 732, a third lock tooth 733 and a fourth lock tooth 734. The radial lengths of the first lock tooth 731, the second lock tooth 732, the third lock tooth 733 and the fourth lock tooth 734 are defined respectively according to the lengths of the outer beads 331 and the inner beads 332 of the lock bead units 33, 34, 35, 36. The indication signs 730 are sequentially arranged as number 1 to number 4 on the lock teeth 73.

The inserting holes 700 of the unlocking blocks 70 are sequentially mounted around the core bar 60. The fitting protrusions 71 of the front fitting portion of the unlocking block 70 that are adjacent to the outer toothed portion 62 are respectively engaged in the engaging recesses 621 of the outer toothed portion 62. The front fitting portion of each unlocking block 70 is engaged with the rear fitting portions of the adjacent unlocking blocks 70. The fitting protrusions 71 of each front fitting portion are respectively engaged in the fitting recesses 72 of the adjacent rear fitting portions. The connecting portion 61 of the core bar 60 is inserted into the central through hole 522 of the rod portion 52, and is screwed in the inner threaded hole 512 of the nut 511. The fitting recesses 72 of the rear fitting portion of the unlocking block 70 that are adjacent to the rod portion 52 are engaged with the engaging protrusions 523 of the toothed portion 520.

In use, with reference to FIGS. 1 and 5, a user holds the holding portion 51 of the handle 50, aligns the positioning sign 514 with the housing indication sign 13 of the lock housing 10 and the core indication sign 28 of the core shell 20, and inserts the outer toothed portion 62 of the core bar 60 into the ring key hole 370 of the key positioning ring 37, the key holes 320 of the lock core units 30 and the key hole 420 of the driving component 40. The unlocking blocks 70 are located in the key holes 320 of the lock core units 30, the toothed portion 520 is located in the ring key hole 370 of the key positioning ring 37, and the positioning column 373 of the key positioning ring 37 abuts the positioning recess 521 of the toothed portion 520.

Figure 8:
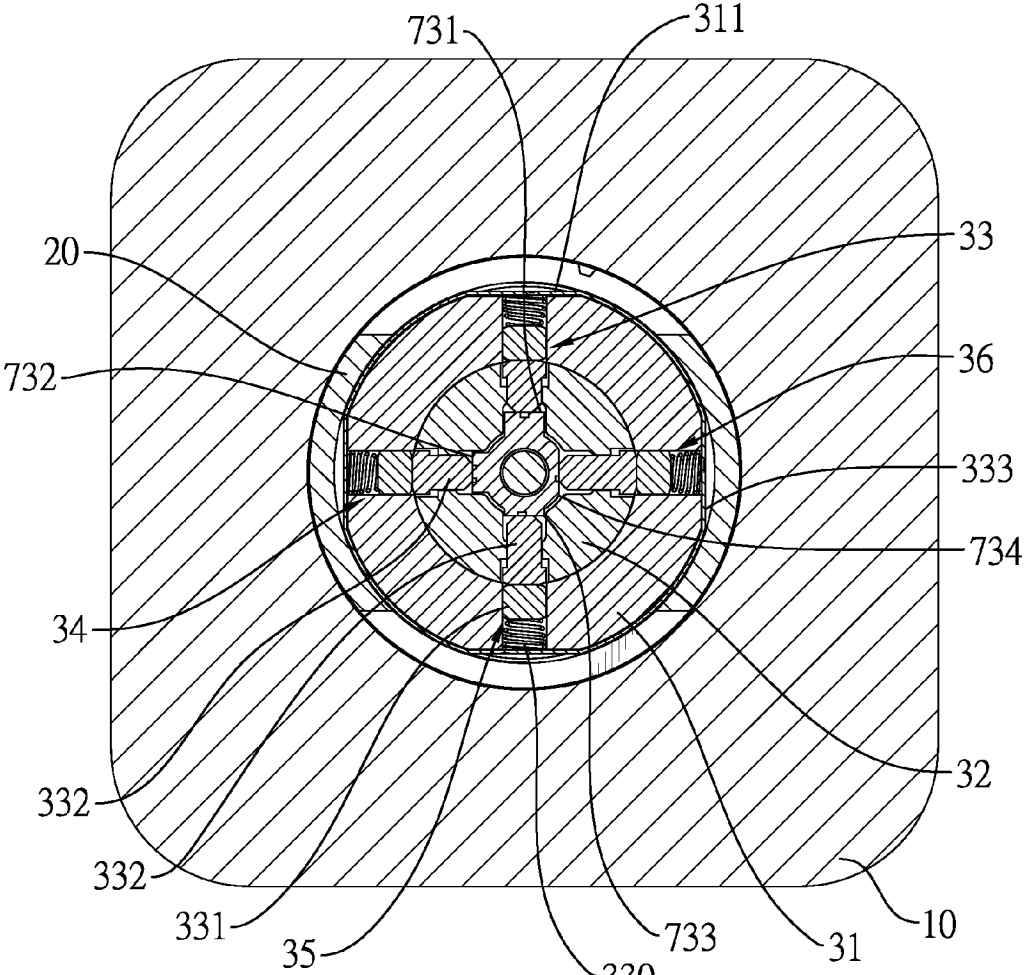
FIG. 8 is a cross-sectional front view of the lock and the key in FIG. 4.

With reference to FIGS. 5 and 8, the lock teeth 73 of the unlocking blocks 70 abut the inner beads 332 of the corresponding lock bead units and push the inner beads 332 to move toward the outer bead 331. When the lock teeth 73 match the lock bead units, a contact boundary between the inner beads 332 and the outer bead 331 is aligned with a contact boundary between the lock ring 31 and the lock core 32. With reference in FIG. 6, the user can rotate the key toward the anticlockwise direction in FIG. 6, the lock core 32 is rotated relative to the lock ring 31 for unlocking or locking.

Figure 6:
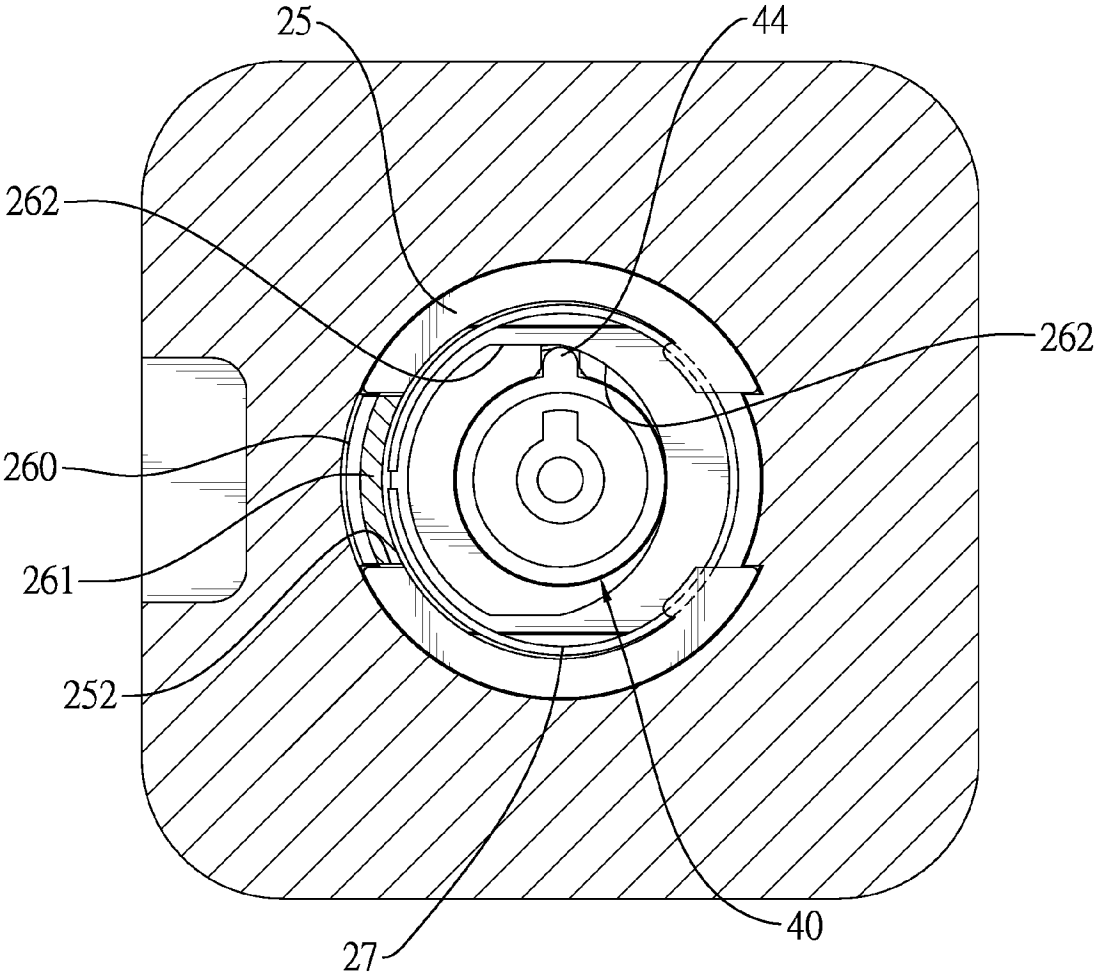
FIG. 6 is a rear view in partial section of the lock and the key in FIG. 5.
Figure 7:
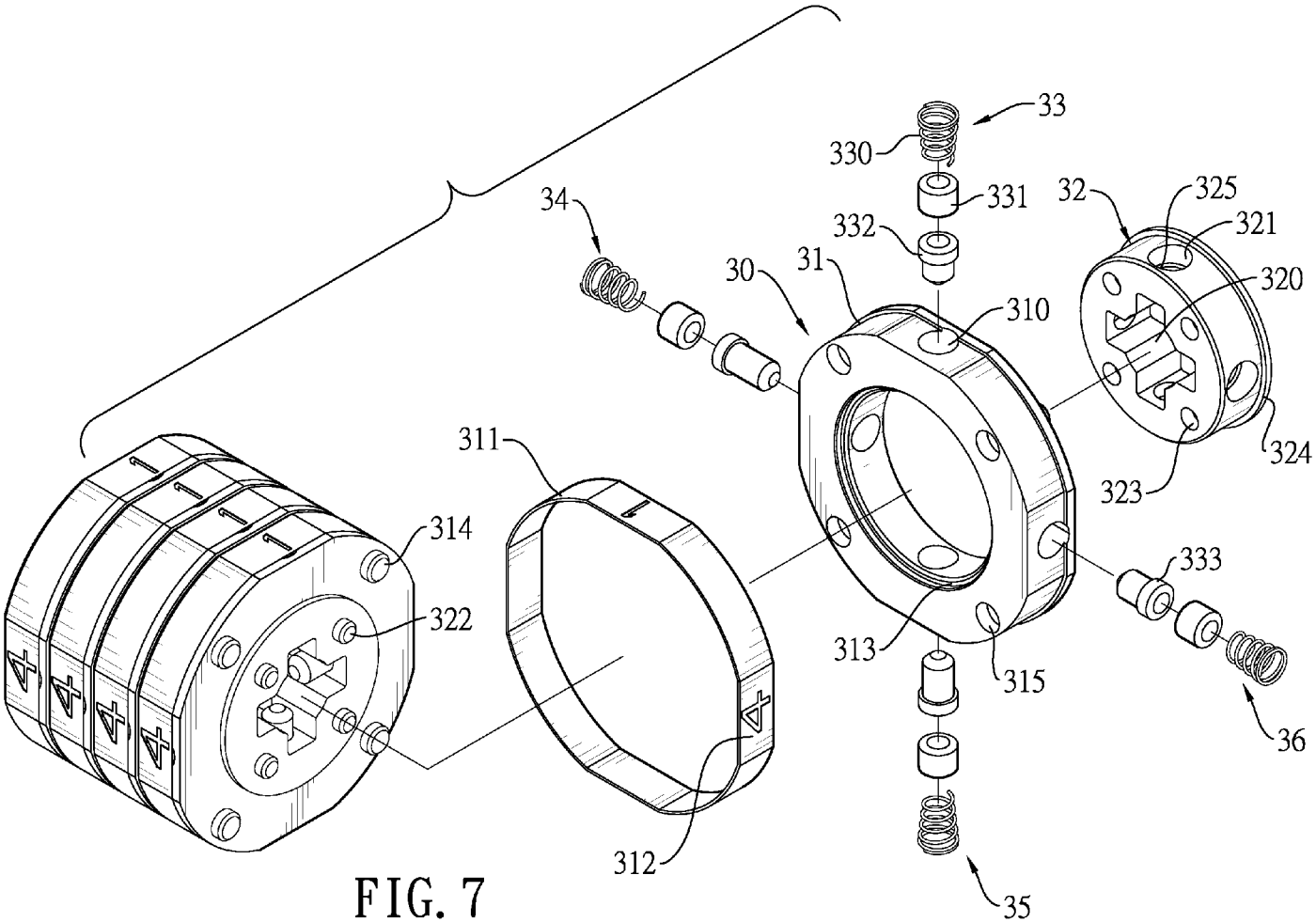
FIG. 7 is an exploded perspective view of a lock core unit in FIG. 2.

If the user wants to change the permutations of the lock bead units of the lock core units 30, the key must be inserted in the key holes 320 of the lock core units 30, the ring key hole 370 of the key positioning ring 37, and the key hole 420 of the driving component 40 and then be rotated toward a clockwise direction in FIG. 6. With reference to FIGS. 2 and 5, the lock teeth 620 of the outer toothed portion 62 are engaged in the key hole 420 of the driving component 40 and rotate the driving component 40. The switch rod 44 is rotated toward the clockwise direction and pushes an inner periphery of the eccentric hole 262 of the engaging disc 26 to make the disc protrusion 260 of the engaging disc 26 retracted in the rear seat 25 and separated from the positioning protrusions 14 of the lock housing 10.

Figure 12:
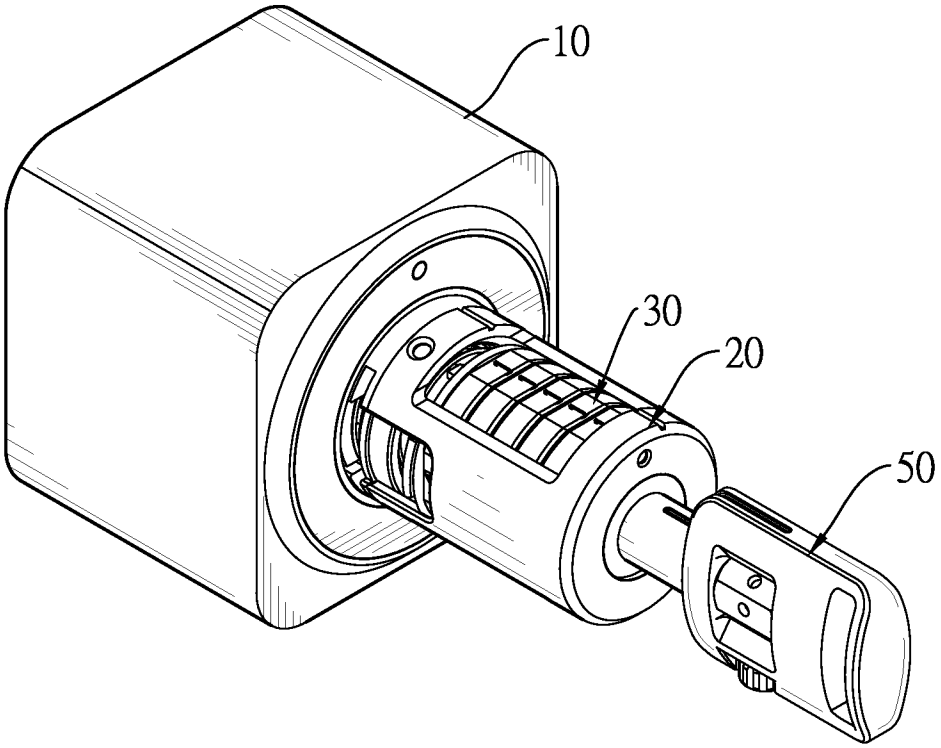
FIG. 12 is an operational perspective view of the lock and key in FIG. 1, wherein the key is inserted into a lock core unit to remove the lock core unit from a lock housing.

With reference to FIG. 12, the user can remove the key, the core shell 20, the lock core units 30 and the driving component 40 from the lock housing 10.

Figure 13:
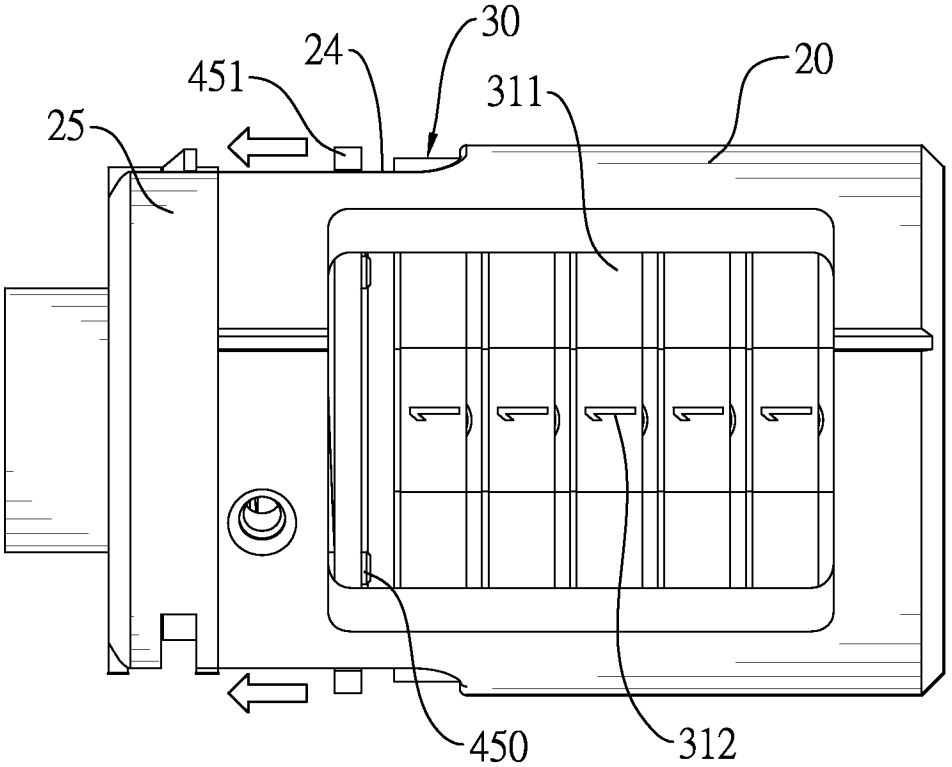
FIG. 13 is an operational side view of the lock core unit in FIG. 12, wherein the lock core unit is being adjusted.

With reference to FIGS. 2, 5, 13, when the user reversely rotates the key and aligns the positioning sign 514 of the handle 50 with the core indication sign 28 of the core shell 20, the key can be pulled out from the lock core units 30 and the driving component 40. The user can place fingers adjacent to the positioning notches 24 of the core shell 20 and pull the buckle portions 451 of the outer positioning ring 45 toward the rear seat 25 to engage the fixing notch 452 of the outer positioning ring 45 with the protrusion 410 of the driving component 40. Thus, the spring 46 is compressed by the outer positioning ring 45 and the engaging columns 450 of the outer positioning ring 45 depart from the ring column recesses 315 of the adjacent lock ring 31. Therefore, the user can respectively rotate the lock rings 31 of the lock core units 30 to different permutations and the indication signs 312 are shown as specific number permutations in the display holes 23 of the core shell 20.

After the adjustment of the lock core units 30, the user releases the buckle portions 451 of the outer positioning ring 45, and the spring 46 pushes the buckle portions 451 toward the lock core units 30 and return to the initial position. Thus, the engaging columns 450 of the outer positioning ring 45 are engaged in the ring column recesses 315 of the adjacent lock ring 31. Consequently, the core shell 20, the lock core units 30 and the driving component 40 are reinstalled in the lock housing 10. Because the permutations of the lock core units 30 are adjusted, the lock teeth 73 of the original key cannot unlock the lock again and enhanced security is provided. Even if the original key is lost, the lock apparatus does not have to be changed. To prevent someone arbitrarily in possession of the lost key from unlocking the original lock, the user only needs to change the permutations of the lock core units 30, and this saves money from changing to a new lock apparatus.

When the user changes the permutations of the lock core units 30, the lock teeth 73 of the unlocking block 70 of the original key must be changed synchronously. With reference to FIGS. 10 and 11, when the positioning screw 53 is removed from the handle 50, the nut 511 becomes rotatable. The user can rotate the nut 511 to move the core bar 60 toward a direction away from the handle 50 through the threaded connection between the inner threaded hole 512 of the nut 511 and the connecting portion 61 of the core bar 60. After the engaging recesses 621 of the outer toothed portion 62 are away from the fitting protrusions 71 of the adjacent unlocking block 70, the unlocking blocks 70 are separated from each other as well. Thus, the user can adjust the indication signs 730 of the unlocking blocks 70 to fit the permutations of the lock core units 30. After the adjustment of the unlocking blocks 70, the user rotates the nut 511 reversely and moves the core bar 60 toward the handle 50, the engaging recesses 621 of the outer toothed portion 62 are engaged with the fitting protrusions 71 of the adjacent unlocking block 70, and the unlocking blocks 70 are engaged with each other. Finally, the positioning screw 53 is mounted in the handle 50 and fixes the nut 511, and the nut 511 becomes non-rotatable. The key is able to be used on the adjusted lock for locking or unlocking.

The key of the present invention is designed for adjustable permutations of the lock teeth 73 and therefore can be used on the lock having the lock bead units for locking or unlocking the lock. If the key is lost, the user just needs to buy a new key having the same structure and adjusts the indication signs 730 of the lock teeth 73 according to the indication signs 312 of the lock bead units in same number combinations, and the new key can be used to lock or unlock the lock and provides great convenience.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock, characterized in that the lock includes a core shell, at least one lock core unit and a driving component;

the core shell is a hollow sleeve and has a display hole;

each one of the at least one lock core unit includes a lock ring, a lock core and at least one lock bead unit, the lock ring is mounted around the lock core, the lock ring has multiple outer bead holes, multiple indication signs are formed on the lock ring and located out of the outer bead holes and part of the indication signs are exposed from the display hole, the lock core is rotatable relative to the lock ring and has a key hole and multiple inner bead holes, each one of the at least one lock bead unit is mounted in one of the outer bead holes and one of the inner bead holes that align with each other, each one of the at least one lock bead unit includes an elastic unit, an outer bead and an inner bead, a ratio of a length of the outer bead to a length of the inner bead of each lock bead unit is different from the ratio of the length of the outer bead to the length of the inner bead of any other lock bead unit, and the at least one lock core unit is mounted in the core shell; and the driving component is rotatably mounted in the core shell, and one end of the driving component is connected with the lock core.

2. The lock as claimed in claim 1, characterized in that an amount of the at least one lock bead unit is four, respectively a first lock bead unit, a second lock bead unit, a third lock bead unit, and a fourth lock bead unit; the first lock bead unit, the second lock bead unit, the third lock bead unit, and the fourth lock bead unit are respectively and sequentially mounted in the outer bead holes and the inner bead holes.

3. The lock as claimed in claim 2, characterized in that the lock ring has multiple ring engaging columns formed on a surface of the lock ring and multiple ring column recesses formed in another surface of the lock ring;

the lock core has multiple core engaging columns formed on a surface of the lock core and multiple core engaging recesses formed in another surface of the lock core; and the ring engaging columns of the lock ring and the core engaging columns of the lock core of each lock core unit engage respectively with the ring column recesses of the lock ring and the core engaging recesses of the lock core of the adjacent lock core unit.

4. The lock as claimed in claim 3, characterized in that the driving component has multiple engaging columns formed on an end of the driving component and engaged with the core engaging recesses of the lock core, and has a fixing block mounted on another end of the driving component.

5. The lock as claimed in claim 4, characterized in that an outer positioning ring is mounted around the driving component, has a hole for being disposed around on an outer periphery of the driving component and multiple engaging columns, the engaging columns of the outer positioning ring are respectively and correspondingly engaged in the ring column recesses of the lock ring, and a spring is mounted between the core shell and the outer positioning ring; and the core shell has positioning notches, and the outer positioning ring has buckle portions movably mounted in the positioning notches of the core shell.

6. The lock as claimed in claim 5, characterized in that the outer positioning ring has a fixing notch formed in an inner periphery of the outer positioning ring, the driving component has a protrusion formed on the outer periphery of the driving component, and the fixing notch is aligned with the protrusion of the driving component.

7. The lock as claimed in claim 6, characterized in that a rear seat is mounted at one end of the core shell, the rear seat has a seat through hole, an engaging disc is moveably mounted in the rear seat, a disc protrusion and a disc abutment block are formed on one side of the engaging disc, an eccentric hole is formed in the engaging disc and is located at an eccentric position, an elastic ring is mounted in the rear seat and respectively abuts on the disc abutment block of the engaging disc and an inner periphery of the rear seat, and the disc protrusion constantly protrudes out of the seat through hole; and a switch rod is mounted on the outer periphery of the driving component, is located in the eccentric hole and moveably abuts on an inner periphery of the eccentric hole.

8. The lock as claimed in claim 7, characterized in that a key positioning ring is rotatably mounted on the end of the core shell, the key positioning ring has a ring key hole and a column hole, the column hole communicates with the ring key hole in a radial direction, a positioning elastic unit and a positioning column are mounted in the column hole, the positioning column has a restricting flange, and the positioning elastic unit abuts on the restricting flange to push the positioning column to moveably protrude into the ring key hole of the key positioning ring.

9. The lock as claimed in claim 8, characterized in that the lock further includes a lock housing being a hollow shell and having a receiving hole formed through a front surface of the lock housing, the core shell is detachably connected with the lock housing, a positioning protrusion protrudes from a periphery wall around the receiving hole, the disc protrusion is engaged with the positioning protrusion of the lock housing, a through hole is formed on a rear surface of the lock housing and communicates with the receiving hole, and the fixing block of the driving component is mounted through the through hole of the lock housing.

* * * * *